US005243750A

United States Patent [19]

Welty

[11] Patent Number: 5,243,750

[45] Date of Patent: Sep. 14, 1993

[54] METHOD FOR FORMING SEAMS IN BOX-SHAPED MEMBERS

[75] Inventor: Robert E. Welty, Cedar Rapids, Iowa

[73] Assignee: Iowa Precision Industries, Inc., Cedar Rapids, Iowa

[21] Appl. No.: 19,233

[22] Filed: Feb. 18, 1993

Related U.S. Application Data

[62] Division of Ser. No. 434,362, Nov. 13, 1989, Pat. No. 5,189,784.

[51] Int. Cl.[5] ..... B23P 19/00

[52] U.S. Cl. ..... 29/509; 29/514; 29/524

[58] Field of Search ..... 29/509, 514, 521, 524, 29/795, 796, 243.5, 243.57, 243.58, 897.3; 72/210, 211

[56] References Cited

U.S. PATENT DOCUMENTS

| | | | |
|---|---|---|---|
| 3,875,642 | 4/1975 | Knudson | 29/243.5 |
| 3,987,740 | 10/1976 | Merson | 29/243.58 X |
| 4,111,143 | 9/1978 | Stubbings | 29/781 |
| 4,395,894 | 8/1983 | McCorvey | 29/243.58 X |
| 4,424,618 | 1/1984 | Stubbings | 29/788 X |
| 4,497,189 | 2/1985 | Larson | 29/243.5 X |
| 4,614,102 | 9/1986 | Karr | 72/178 |
| 4,918,797 | 4/1990 | Watkins et al. | 29/243.5 |

*Primary Examiner*—Timothy V. Eley
*Attorney, Agent, or Firm*—James C. Nemmers

[57] ABSTRACT

A method and apparatus for forming the locking bend on a Pittsburgh type seam used in joining the sections during assembly of box-shaped sheet metal ducts. The apparatus provides a means for securely holding the duct without the use of a mandrel to permit the sheet metal along the seam to be bent over by a forming roller moving along the seam so as to complete the joint and lock the seam.

3 Claims, 2 Drawing Sheets

METHOD FOR FORMING SEAMS IN BOX-SHAPED MEMBERS

This is a division of application Ser. No. 434,362, filed Nov. 13, 1989 now U.S. Pat. No. 5,189,784.

BACKGROUND OF THE INVENTION

Rectangular or box-shaped ducts are extensively used in heating and ventilating systems to distribute heated or cooled air throughout a structure. These ducts are commonly formed from different gauges of sheet metal in sections of predetermined length which are then connected to form a continuous duct for distributing air. Each section of a duct is formed by bending two pieces of sheet metal of the desired length at a 90° angle, and with the Pittsbugh type of seam, one edge of each piece is formed with a longitudinally extending grove to form the female portion of the joint, while the other edge is bent over along its length to provide the male portion of the joint. The two parts are then assembled by inserting the male portion of each part into the female portion leaving an edge extending beyond the joint from the female portion, which edge must then be bent over to lock the seam. At the present time, this edge is bent over manually using either a hand hammer or a power hammer. This is not only a time consuming and tedious task, but because these ducts are metal and hollow, they amplify the sound. The noise created by hammering over the free edge to lock the seam is so noisy that some regulatory agencies have taken steps to require the worker's hearing to be protected or this method of the locking joint cannot be used.

Attempts have been made to develop an improved method of locking the Pittsburgh type joint, but such efforts have not been successful because they have all required the use of a mandrel inside of the duct. Many of these air ducts are being formed with insulation on the inside, and a mandrel simply will not work with such ducts. Therefore, the prior art has not provided any solution that will eliminate the tedious task of locking these joints to complete the assembly of the ducts, and more importantly, nothing has been developed to eliminate the noise from the assembly process.

There is therefore an obvious need for an improved way of completing the assembly of the sections of box-shaped sheet metal ducts which are assembled using Pittsburg type or similar locking seams. Any such method and apparatus must be simple to use, inexpensive, portable, and above all it must minimize if not eliminate the noise associated with the formation of these lock-type seams.

SUMMARY OF THE INVENTION

The method and apparatus of the invention provides a simple, inexpensive way of completing the formation of these lock-type seams for sheet metal ducts by using a power roller to bend the edge over to lock the two female and male members and thus complete the seam. The apparatus provides a station with a support for the pre-assembled box-shaped duct, which support includes positioning stops to properly position the two sides of the duct so that the edge of the seam to be bent is in the path of a moveable forming roller. The support also includes a positive holding means to hold the duct in place against the force that will be applied by the roller in bending the edge to complete the seam and lock it. A carrier containing the forming roller or rollers is moveable along a predetermined track or path, and with the properly positioned duct supported and held in place, the roller will bend the edge at approximately a right angle to complete the seam.

DESCRIPTION OF THE PREFERRED EMBODIMENT OF THE INVENTION

Figure 1:
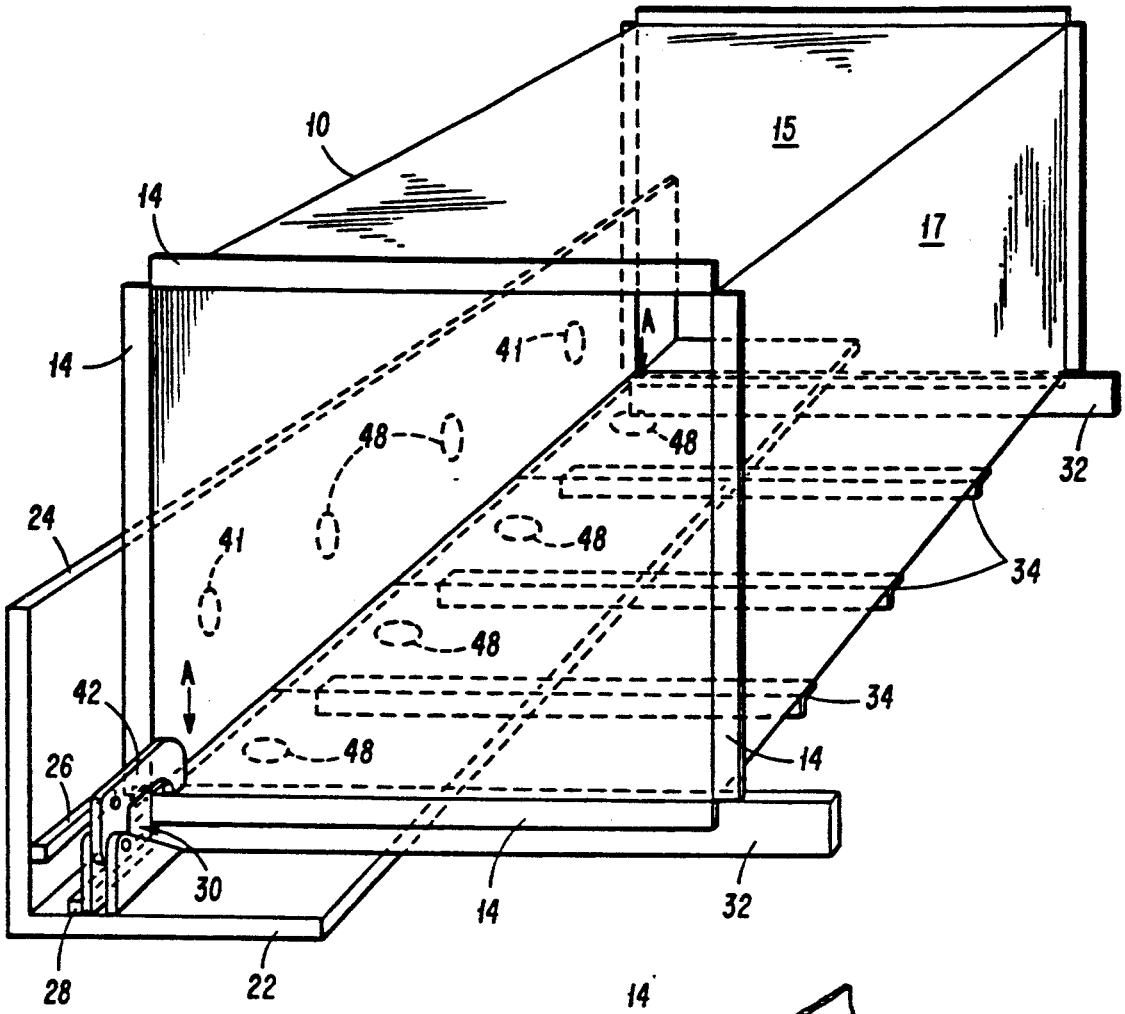
FIG. 1 is a perspective view of the operating portions of the apparatus of the invention.
Figure 2:
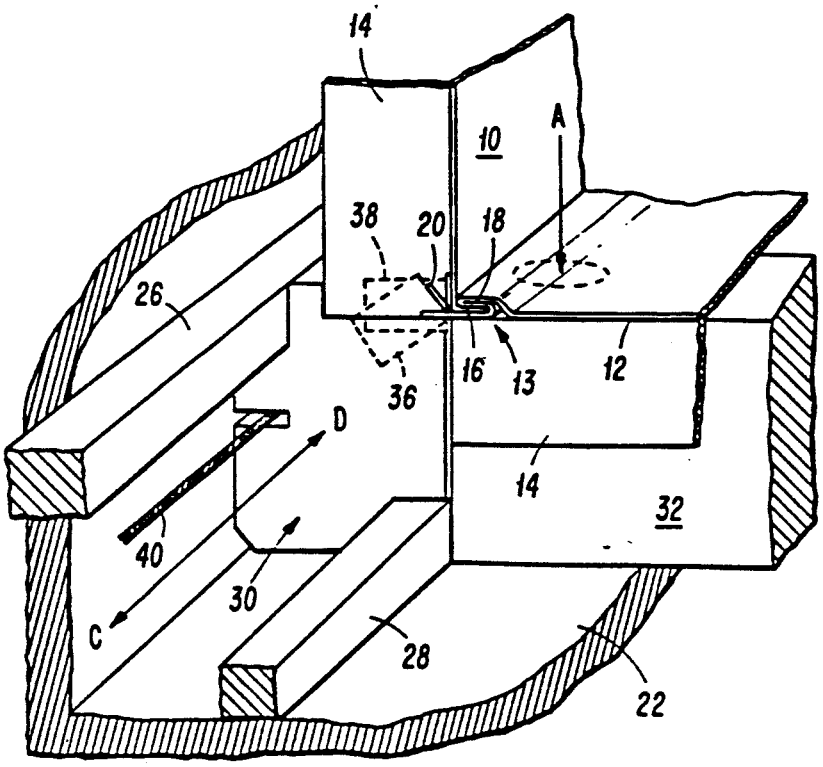
FIG. 2 is an enlarged view of a portion of FIG. 1 to illustrate the operation of the moveable carriage that carries the forming rollers.

Referring first to FIG. 1, there is illustrated a pre-assembled box-shaped duct having two sides 10 and 12 held together by a Pittsburgh-type seam 13 (see FIG. 2). The duct of FIG. 1 also shows two sides 15 and 17 of the duct opposite sides 10 and 12, which sides 15 and 17 may also be joined at a corner by a seam similar to seam 13. However, some duct sections are formed from a single piece of sheet metal that is formed into a box shape and joined at one corner by a single seam. The invention will be described as applied to a box-shaped duct section, but it should be understood that the invention is applicable to any corner seam of this type regardless of the finished product in which it is used. As is well known, the four sides of the duct are pre-assembled before the joints are locked. Also, it is common to form these box-shaped ducts from two pieces of sheet metal of the desired approximate length of the finished section of the duct. After cutting to the proper size, each piece of sheet metal is bent approximately 90° to form one part which provides two sides of the finished duct section. Along one edge of each part there is formed the female portion of a Pittsburgh-type seam while along the other edge of each part there is formed the male portion of the seam. In FIG. 1, side 10 represents one-half of one part while side 12 represents one-half of the other part. Also, as is common in the industry, the ends of each of the sides 10, 12, 15 and 17 are bent outwardly to form flanges 14.

Referring now to FIG. 2, one longitudinal edge of side 10 is bent to form the male portion of the seam 13, this portion being formed by bending the entire edge of side 10 inwardly at approximately a right angle. This edge, designated by the reference numeral 16, forms the male portion of one of the two seams 13 that will be locked to complete the finished box-shaped duct.

The other side 12 of the pre-asembled duct has formed along one of its edges the female portion of the seam 13, this female portion 18 having a longitudinally extending groove with an edge 20 extending outwardly beyond the groove generally in the plane of the side 12.

When the parts of the duct are pre-assembled, the male edge 16 is inserted into the female portion 18 leaving the edge 20 extending beyond the partially formed seam. When both parts of the duct section are thus pre-assembled, the box-shaped section will be formed, but the seams at opposite edges of the duct section will not yet be locked. In order to lock these seams, it is necessary to bend the edge 20 inwardly so that it lies against the outer surface of the side 10. When this is done, the seam will be locked. This type of seam is commonly referred to as a "Pittsburgh" seam. As previously indicated, the common method of completing the assembly by locking the seams is to use a hammer to bend over the edge 20. Although power hammers are frequently used to perform this task, the task is still time consuming and especially quite noisy since the pre-assembled duct section acts as a sound amplifier, and being made of metal, the noise can be deafening. The method and apparatus of the invention overcomes these disadvantages of the prior art.

The apparatus of the invention has a table 22 that is mounted on any suitable support (not shown) so that it is positioned in a generally horizontal plane. The table 22 may be mounted, for example, so that it can be used in the back of a truck and carried to the job site. Since box-shaped duct sections are generally made in standard lengths, the table 22 need not be much longer than the length of the section being formed. Thus, the apparatus is easily portable.

Affixed to the table 22 is a vertically extending back 24. The table 22 and back 24 provide support for two guide rails 26 and 28, respectively, which define the path of travel for a forming carrier indicated generally by the reference numeral 30. Table 22 also supports two arms 32 that extend outwardly from the back 24 over the table 22 to provide additional support and positioning stops for the pre-assembled duct section. Arms 32 also provide an open area between them and above the table 22 so that duct sections containing stiffeners 34 on their outside surfaces can be assembled. Also, as illustrated in FIG. 1, arms 32 are spaced a predetermined distance so as to be just inside of the flanges 14, thus properly positioning the sides 10 and 12 in the apparatus.

Figure 3:
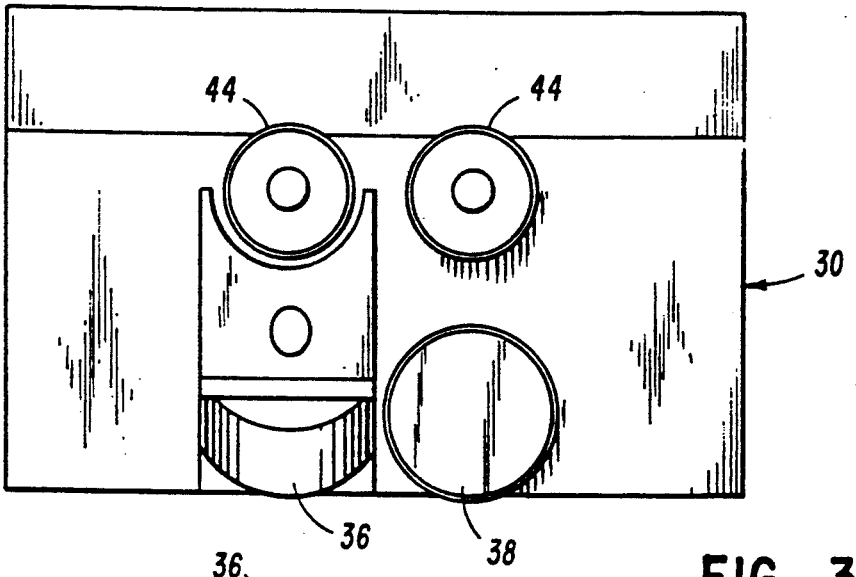
FIG. 3 is a top plan view of the rollers and their carrier.
Figure 4:
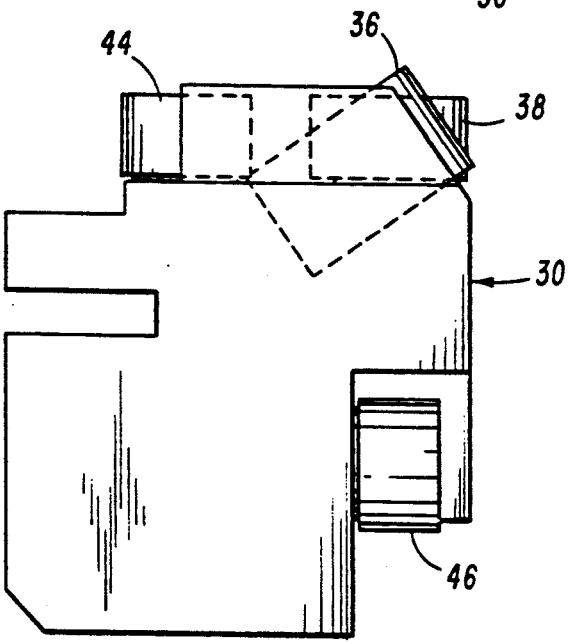
FIG. 4 is a side elevational view of the carrier and rollers of FIG. 3.
Figure 5:
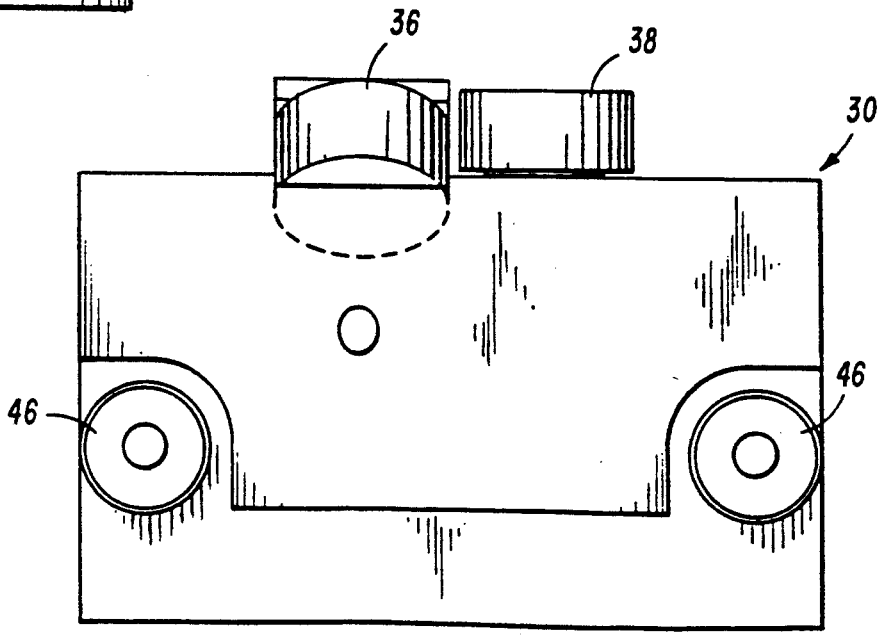
FIG. 5 is a front elevational view of the carrier and rollers.

Referring now especially to FIGS. 3, 4 and 5, the forming carrier 30 is shown as supporting two forming rollers 36 and 38. Forming roller 36 is mounted with its axis at a predetermined desired angle, such as 45°, so as to make the initial bend of the edge 20 as the carrier 32 moves in the manner described hereinafter. Forming roller 38 is next to and upstream from forming roller 36 and is positioned so as to complete the right angle bend of edge 20 until that edge 20 lies against the outside surface of side 10 to complete the and lock the seam, as is well known.

The forming carrier 30 moves back and forth along and between the guide rails 26 and 28, riding on a pair of upper bearings 44 and a pair of lower bearings 46. The forming carrier 30 is powered in any suitable manner, such as by a rack and pinion arrangement (not shown) or by being pulled back and forth by attachment to a cable 40 which is connected to a drum and pulley arrangement (not shown) with the drum being powered by a suitable motor.

With the sides 10 and 12 positioned on the support arms 32 as illustrated in FIG. 1, the operator then moves the pre-assembled sides 10 and 12 toward the back 24 until it is properly positioned. If desired, suitable positioning stops 41 can be mounted on the back 24, which stops 41 may be made adjustable for different gauges of sheet metal being used for form the duct section. Once the sides 1O and 12 are properly positioned, they must be held in place against the force of the moving forming carriage 30. Any suitable holding means can be used. For the entire table 22 and back 24 can be magnetized so as to positively hold the sides 10 and 12 in place. As illustrated in FIG. 1, the use of a clamping device 42 is preferred, and device 42 should be power operated by an air or hydraulic cylinder (not shown). Also, the sides 10 and 12 should be held and clamped in the general location indicated by the letters "A" in FIGS. 1 and 2. The clamping device 42 may include a holding pin (not shown) which bears against and may slightly penetrate the sides 12 and thus clamp them securely against the support arms 32. Also, it may be desirable to use vacuum cups 48 to help stabilize the duct section, especially when lighter gauge metal is being used for the duct section. These vacuum cups 48 may also serve as the stops 41. The specific holding means does not form a part of the invention, and use of a particular type is within the skill of persons skilled in the art.

Although the operation of the apparatus and the method of locking the seam should be evident from the foregoing description, the operation of the apparatus and the method of locking is summarized as follows. With the duct section having been pre-assembled with the male portion 16 of side 10 inserted into the female portion 18 of side 12, and with the carriage 30 at one end of the guide rails 26 and 28, the duct section is placed on the support arms 32 and moved toward the back 24 until the edge 20 of seam 13 is properly positioned in the path of the forming rollers 36 and 38. Once properly positioned, the clamping device 42 is actuated to positively hold the sides 10 and 12 in the proper position. The movement of the forming carriage 30 is then started, and as the first forming roller 36 engages the edge 20, it will be bent partially upwardly thus completing the initial bend of the edge. This is illustrated in FIG. 2 which shows the edge initially bent to approximately a 45° angle. As the forming carriage 30 continues to move, the forming roller 38 will engage the edge 20 and complete the locking of the seam by bending the edge 20 a full 90° until it is pressed against the outside surface of the side 10. This completes the "Pittsburgh" lock. The carriage 30 will continue to be powered along the guides 26 and 28 until it has moved along the entire length of the seam 13. When the seam is completed, the carriage 30 is stopped, either manually or a suitable limit switch (not shown) can be provided to stop the carriage 30 and reverse its direction. The carriage moves in the directions "C" and "D" as indicated in FIGS. 1 and 2. Obviously, if the duct section to be formed has flanges 14, the rollers 36 and 38 will not be able to reach the end of the seam. In this event, the operator will have to manually bend over the first inch or so of the seam at each end of the duct section. This will have to normally be done before the carriage 30 starts moving.

Also, it will be evident to those skilled in the art that it may not be necessary to use progressive forming rollers such as the rollers 36 and 38. In many instances, a single forming roller can be used to make the 90° bend. However, if the machine is to handle sheet metal of different gauges, it has been found that progressive forming rollers will produce a better seam.

Once the seam is completed, the clamping device is released and the duct section removed from the apparatus. If the duct section has a second corner seam, and the operation is then repeated for the other seam at the opposite corner of the duct section.

Having thus described the invention in connection with a preferred embodiment thereof, it will be evident to those skilled in the art that various revisions and modifications can be made to the preferred embodiment disclosed herein without departing from the spirit and scope of the invention. It is my intention however that all such revisions and modifications as are obvious to those skilled in the art will be included within the scope of the following claims.

What is claimed is as follows:

1. A method of locking a Pittsburgh-type seam used to join together two members of deformable material having juxtaposed edges that form a corner, said method comprising the steps of: forming the juxtaposed edge of one member with the female portion of a Pittsburgh-type seam and the edge of the other member with the male portion of the Pittsburgh-type seam; inserting the male portion into the female portion to partially join the members and leave a longitudinally extending edge along the female portion, the extending edge extending beyond the seam; positioning the partially joined members with the extending edge extending into the path of a longitudinally moveable forming means; holding at least one of the members so that the extending edge does not move relative to the path; and moving the forming means along the extending edge so as to bend the edge at an angle of approximately 90° to lock the seam and complete the joinder of the members.

2. The method of claim 1 in which the the forming means includes guides for guiding the movement of the forming means along its defined longitudinal path, and the forming means also includes at least one forming roller positioned to roll and bend the longitudinally extending edge as the forming means moves along its path.

3. The method of claim 2 in which the forming means includes a pair of forming rollers, the first roller being positioned ahead of the second roller in the direction of movement of the forming means so as to make an initial bend of the longitudinally extending edge through a part of the 90° angle, and the second roller being positioned behind the first roller so as to engage the partially bent edge to complete the bend of the edge at an angle of approximately 90° to lock the seam.

* * * * *